US005580688A

United States Patent [19]

Hirt

[11] Patent Number: 5,580,688

[45] Date of Patent: Dec. 3, 1996

[54] METHODS FOR ENHANCED-CONTRAST PRINTING WITH FERROELECTRIC MATERIALS

[75] Inventor: Alfred Hirt, München, Germany

[73] Assignee: MAN Roland Druckmaschinen AG, Offenbach am Main, Germany

[21] Appl. No.: 293,644

[22] Filed: Aug. 22, 1994

[30] Foreign Application Priority Data

Aug. 20, 1993 [DE] Germany ..... 43 28 037.4

[51] Int. Cl.[6] ..... G03G 13/32

[52] U.S. Cl. ..... 430/35; 430/49; 430/126

[58] Field of Search ..... 445/24; 430/126, 430/35, 51

[56] References Cited

U.S. PATENT DOCUMENTS

| | | | |
|---|---|---|---|
| 2,914,403 | 11/1959 | Sugarman | 430/54 |
| 3,899,969 | 8/1975 | Taylor | 101/130 |
| 4,919,633 | 4/1990 | Yamazaki et al. | 445/24 |

FOREIGN PATENT DOCUMENTS

| | | |
|---|---|---|
| 2530290 | 1/1976 | Germany . |
| 3835091 | 4/1990 | Germany . |
| 4106353 | 9/1992 | Germany . |

*Primary Examiner*—John Goodrow

*Attorney, Agent, or Firm*—Cohen, Pontani, Lieberman, Pavane

[57] ABSTRACT

Various processes for enhancing the contrast between image and non-image regions of a printed image are implemented by increasing the toner-accepting charge on the surface of a printing form having a ferroelectric layer and from which the image is printed. The increase in charge is achieved, in alternate forms of the inventive process, either by increasing the temperature of the printing form surface relative to the temperature at which the form has been polarized, or by mechanically loading the printing form carrying cylinder for transfer of the toner from the printing form, or by applying additional charge carriers to the entire surface of the printing form (30) so as to create an enhanced potential difference between positively-polarized regions and negatively-polarized regions and, thereby, increased contrast between image and non-image regions.

20 Claims, 4 Drawing Sheets

METHODS FOR ENHANCED-CONTRAST PRINTING WITH FERROELECTRIC MATERIALS

FIELD OF THE INVENTION

The present invention is directed to printing processes and, more particularly, to processes for reproducing a master image or image pattern using a printing form having a surface layer of ferroelectric material.

BACKGROUND OF THE INVENTION

A printing process for applying or transferring a ferroelectric image pattern to a web or substrate using electrically-charged toner particles is disclosed in German patent publication DE 38 35 091 C2. In accordance with that process, the ferroelectric material may be polarized in different directions within unusually narrow regions; this permits the attainment of very high-resolution printing using monochrome toners and, using two colors of toner having differently charged particles—i.e. one containing positively-charged particles and the other containing negatively-charged particles—both colors may be applied simultaneously to the ferroelectric surface in a single printing step or pass thereby minimizing the number of passes required to transfer or apply the image to the substrate. The priming form and therein-disclosed process are suitable for use with dry toners as well as with toners that are dissolved in moistening agents that serve as carriers for the toner. This reference does not specify particular temperatures at which the printing form is operatively polarized.

U.S. Pat. No. 3,899,969, on the other hand, discloses a method for printing an image on a substrate using a pyroelectric material upon which a charge pattern representing the image to be reproduced has been established through the application of an electric field. The placement of the image-representing charge pattern to the pyroelectric material, which is also a ferroelectric material, is carried out by polarizing the material at very high temperatures, e.g. 150° C., while the electric field is applied. For this purpose the material to be polarized must, for example, be placed in a bath of hot oil.

German patent publication DT 25 30 290 A1 teaches a one-time application of an external electric field to a ferroelectric material after a polarization process for producing a latent image on the surface of the ferroelectric material. However, the charges applied to the surface of the ferroelectric material by the electric field are only proportional to the field strength of the applied field, as in the case of a capacitor, and are therefore limited in magnitude. Moreover, since the surface-carried charges are transferred along with the toner image to the substrate upon which the image is to be reproduced, only a limited number of copies can be thus printed from the latent image carried on the ferroelectric material before all of the free charges that were generated by the applied external field have been consumed. This is similarly true with respect to the use of the pyroelectric or piezoelectric effect which is produced by heating the ferroelectric material or by applying pressure thereto. As a consequence, the process taught in German publication DT 25 30 290 A1 is not a continuous printing process but, rather, a mere copying process useful for producing only a limited number of copies.

OBJECTS AND SUMMARY OF THE INVENTION

It is accordingly an object of the present invention to provide printing processes for producing large numbers of copies of an image and in which the print quality, i.e. the contrast, of the resulting printed image is notably improved over known printing methods and techniques.

It is another object of the present invention to provide processes for transferring images to a printing form in a manner such that the contrast of the resulting printed images is likewise notably improved when printing is carried out with the printing form so provided.

In accordance with the processes of the present invention, and in marked distinction to the prior art, new charge carriers are continually applied to the printing form, as the form is used for transferring images to a plurality of substrates, to thereby increase the contrast of the image such that toner which is deposited on the substrate in accordance with the toner image can be dispersed on the polarized locations to a greater degree.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals identify similar elements throughout the several views.

DETAILED DESCRIPTION OF THE PREFERRED EMBODIMENTS

Figure 1:
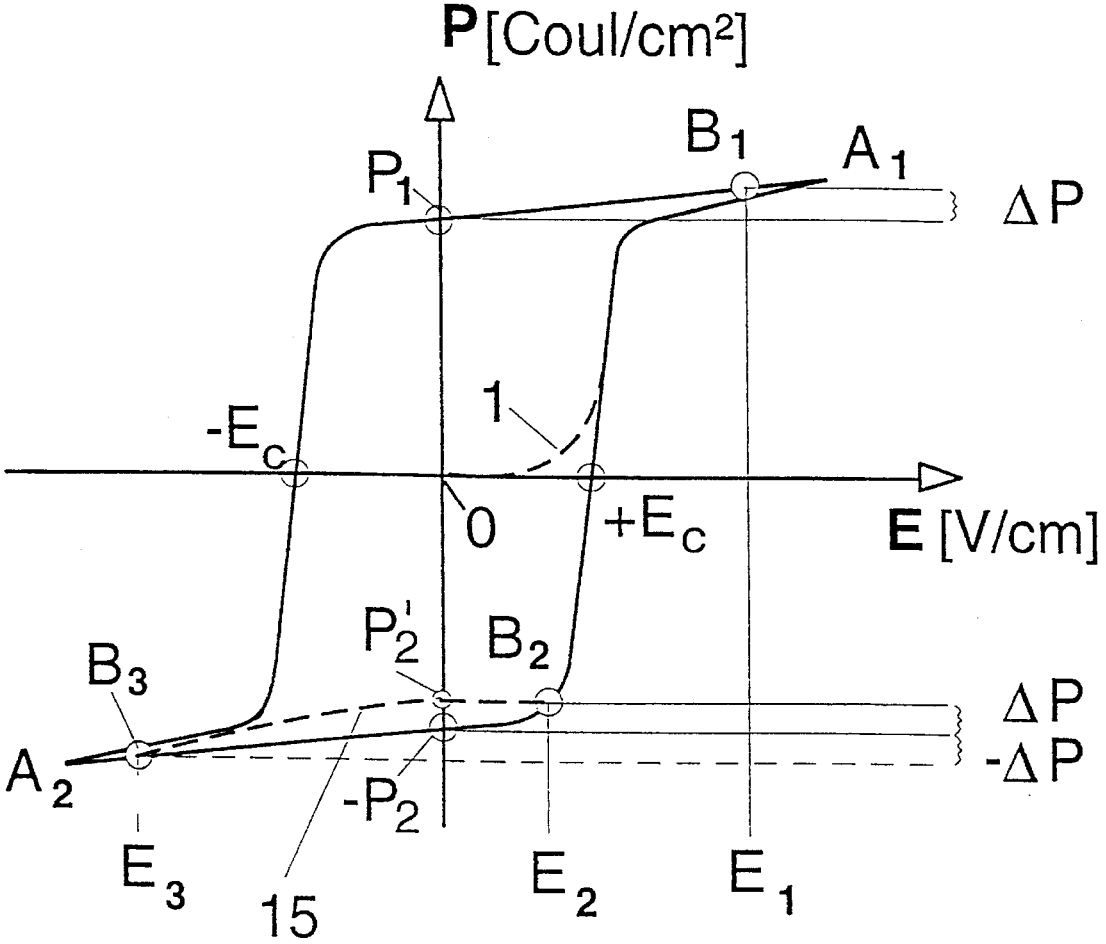
FIG. 1 graphically depicts a hysteresis loop illustrating the operating principles of the novel processes of the present invention.

Ferroelectric material is characterized in that its microscopic constituents, i.e. its elementary cells, have a stable electric dipole moment that may be aligned along and in accordance with an electric field. Ferroelectric materials include, by way of example, inorganic ceramic materials with an asymmetrical perovskite structure, e.g. barium titanate, lead zirconate and combinations thereof, and organic substances such as polyvinylidenefluoride with C-F chains as elementary dipoles. The inorganic ferroelectric materials have structures in which the elementary cells are arranged asymmetrically in such a way that them exist two modifications of equivalent energy and identical structure, i.e. enantiomorphous modifications, which can only be changed from one state to the other through the supplying of energy—e.g. by the action of external forces such as from an applied electric field or by means of thermal energy.

Where the energy is supplied by an electric field, those cells existing in energy states that are not oriented in the direction of the applied field switch to the direction of the field when the field has a magnitude above a predetermined material-dependent field strength—the so-called coercive field strength—and will then remain in this reoriented direction or state when the electric field is subsequently removed. This process is known as poling of the ferroelectric material.

When, on the other hand, the dipole-orienting energy is supplied by heat, dipole modifications to both cell states are equally probable due to vibrations of the thermal lattice vibrations after the material reaches the Curie temperature, so that the dipoles completely lose any alignment produced by an external electric field when the field is removed. Thus, the ferroelectric material switches to the paraelectric state at temperatures above the Curie temperature. If then cooled so as to pass from the paraelectric state to the ferroelectric state in the absence of an external field, randomly oriented regions called domains—whose field effects cancel each other out—are formed, resulting in a macroscopically neutral nonpolar state of the material.

When the ferroelectric material is polarized below its Curie temperature, the electric field generated by the alignment of its dipoles cannot propagate to the surface of the material. That is, since the lines of electric flux are not self-contained but, rather, always end in charges, a layer of surface charges which stabilizes the field in the interior of the ferroelectric material is formed on both (i.e. opposite) surfaces of the ferroelectric layer. As a consequence, after removal of any electrodes used for poling, a poled ferroelectric plate may likewise be viewed as similar to an electrical capacitor whose electrodes carry surface charges that are bound by the interior electric field.

Most of the interior field is outwardly shielded by these surface charges. However, this shielding is not complete; a residual field sufficient for the printing process acts or extends outwardly and is capable of attracting electrically-charged particles, as for example an electrostatic toner. Poling to form images is thus carried out by aligning the dipoles in image regions and in background regions in respectively different directions, as for example disclosed in aforementioned German publication DE 38 35 091 C2.

FIG. 1 is a graph which plots electric field strength E against surface charge density P, and depicts a hysteresis curve of a ferroelectric material. More particularly, the surface charge density P of the electric charge flowing at the surface of the ferroelectric material is represented as a function of the electric field E in the interior of the material. When a ferroelectric material in a randomly oriented, macroscopically-neutral state is poled to the positively-polarized state, the so-called virgin curve 1 passes from the origin (point 0) to point $A_1$. When the electric field is then switched off, the material remains in the stable poled state $P_1$. When an opposite field is next applied, the curve passes or returns from point $P_1$, via point $A_2$, to point $P_2$. This process is reversible and may be repeated as often as necessary. Accordingly, the image points of the ferroelectric material are in a state Pt after poling whereas the background regions, i.e. the non-image regions, are in a state P2. As should be apparent, the opposite polarization may similarly be carried out with like results. It is additionally possible for only the image regions to be polarized in the positive or negative sense (i.e. direction) while the non-image regions remain neutral.

Figure 2:
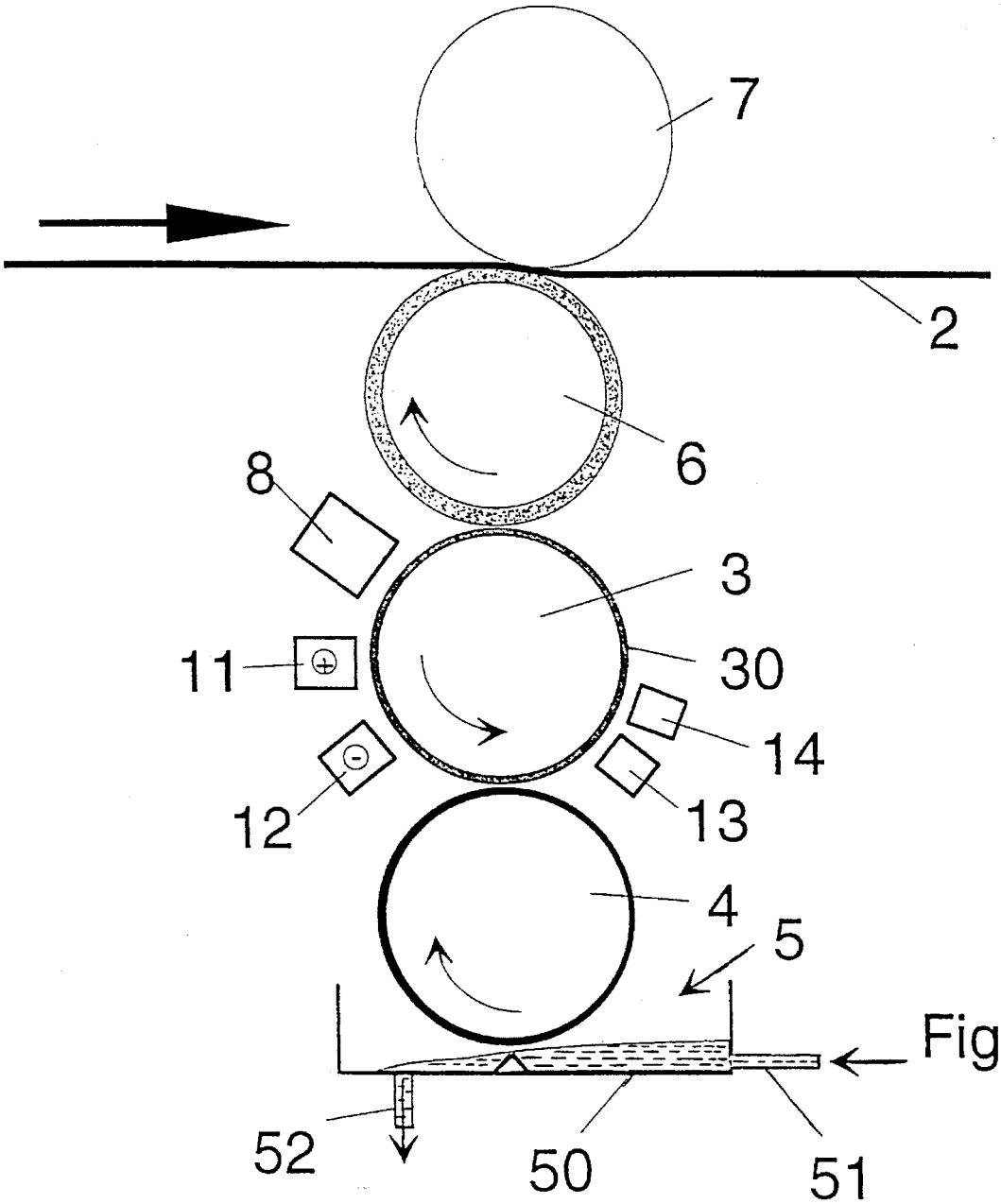
FIG. 2 diagrammatically depicts apparatus for printing with a ferroelectric material in accordance with at least a first embodiment of the present invention, wherein the outer surface or layer of the form cylinder is coated with a layer of ferroelectric material and charge sources are arranged proximate the cylinder surface.

FIG. 2 depicts a printing apparatus for printing images on a substrate or web 2 of printing stock using a form cylinder 3 whose outer surface area is peripherally surrounded by or carries a printing form 30 either entirely fabricated of ferroelectric material or having at least an outer layer of ferroelectric material. The printing form 30 receives toner—for use in transferring an image to the web 2—from a toner applicator roller 4 which, in turn, receives toner from a toner pan 5. The toner pan 5 contains a supply 50 of toner that is maintained at a predetermined or fixed level via a toner feed 51. Toner that is not taken up by or otherwise deposited onto the toner applicator roller 4 is directed through a toner drain 52 to a filtering arrangement (not shown) and thereafter returned to the toner pan 5 by the toner feed 51. Toner particles that are applied to the surface of the printing form 30 on the form cylinder 3 in accordance with (i.e. in a manner representative of) images to be transferred from the form 30 to the web 2 are transferred by way of an interposed transfer cylinder 6 to the printing stock web 2, the transfer cylinder 6 pressing the printing stock web 2 against a printing cylinder 7.

However, before the printing form 30 can be used for printing in conjunction with electrostatically-charged toner, the form must be provided with the images to be printed through operation of an imaging unit 8 to effect polarization of the ferroelectric material as hereinabove described. The amount of free charge available on the printing form surface is then increased, electrically, for printing with the toner.

For this purpose, charge sources 11, 12—which charge the surface of the printing form 30 either positively or negatively—are disposed adjacent or in otherwise appropriate proximity to the form cylinder 3. Corona dischargers, contacting dielectrics, poorly conducting films or individual electrodes that are separated in accordance with the image points may, by way of example, be employed as charge sources. The charge sources 11, 12 may either be the same as those previously used to predeterminately polarize the printing form 30 in accordance with a particular image, or may comprise different charge sources 11, 12 as depicted in FIG. 2.

With reference now to FIG. 1, after the imaging process—i.e. after the electrodes of the imaging unit 8 are once more at zero potential—the printing cylinder image points are at polarization state $P_1$ and/or the non-image (e.g. background) image points are at polarization state $P_2$. In accordance with the present invention, the printing form 30 is then again charged with a predefined charge of, for example, $\Delta P$—but this time over the entire surface of the form 30—as a result of which those image points previously at polarization state Pt are raised to an electric potential $E_1$, and those image points previously at polarization state $P_2$ are raised to a potential $E_2$. In the absence of the additional charge $\Delta P$ that has now been applied to the entire imaging region of the printing form 30, only the relatively low potential difference generated by the residual electric field would exist between the positively and negatively polarized regions $P_1$, $P_2$. By virtue of the additional applied charge $\Delta P$, these two oppositely-polarized regions now exhibit a potential difference $\Delta E=E_1-E_2$. This potential difference AE results in an imaging contrast between the two regions that is greater than the original contrast in the polarized but uncharged ferroelectric material of, e.g., a factor of 100. As should be apparent, the printing form 30 may alternatively, and with like results, be charged over its entire imaging surface with negative charge carriers instead of the positive charge carriers just described.

The resulting ferroelectric printing form 30 charged in accordance with the present invention, having been poled once in accordance with the image to be printed and then receiving the uniformly-applied additional charge ΔP, is able to accommodate or withstand a notably greater number of printing passes or processes. However, it will be recognized that the charge density P in the region bounding the charge carriers at point $B_1$ (FIG. 1) is greater than the charge density of the charge carriers at point $B_2$, since the applied additional charge ΔP at point $B_1$ causes an increase in the field strength in the ferroelectric layer whereas the applied additional charge ΔP at point $B_2$ causes a reduction in the field strength in the ferroelectric layer. These charges are released and the printing form is partially depolarized in the region of negative polarization from the earlier polarization state $P_2$ to a polarization state $P_2'$. To remedy and reverse this depolarization, the printing form 30 may be acted upon by negative charge carriers, by which the ferroelectric material then passes through a polarization curve 15 from point $P_2'$ to point $A_2$. Once point $A_2$ has again been reached, the ferroelectric material may be positively charged again until attaining point $B_2$. This is likewise true, to a lesser degree, with respect to point $B_1$. The unipolar charging of the printing form 30—e.g. only with positive charge carriers—thus provides a contrast $\Delta E=E_1-E_2$ with positive potential at both image locations and non-image locations. An attracting or repelling effect for the toner particles is produced by adjusting the potential of the toner applicator roller 5 to a level between $E_1$ and $E_2$.

For this reason, it is important during a continuous printing process of long duration that a ferroelectric material which is positively charged, by way of example, be charged periodically with negative charge carriers. In this manner both polarization states are completely regenerated.

The process of the present invention may be carried out in another, related manner such that increased contrast is achieved in connection with the production of images. The printing form 30 is first negatively polarized on its entire imaging surface by a first electrode and is then negatively charged by an additional value ΔP with negative charge carriers (i.e. electrons) and thus brought to a potential $E_3$ (point $B_3$ in FIG. 1). The image regions on the surface of the printing form 30 are next polarized in the positive direction or sense by a second electrode and are then positively charged to potential $E_1$ (point $B_1$) by removal of electrons to a value ΔP so that there is a potential difference $\Delta E'=E_1-E_3$ between the image points $B_1$ and non-image points $B_3$.

In addition to this process, the number of free charges on the surface of the printing form 30 may be increased through the application of heat. For this purpose, the printing form is first provided with images at a temperature $T_1$ of, by way of example, approximately 20° C. In order to achieve and maintain this temperature of the printing form, the entire printing device may be, and is preferably, subjected to this temperature—for which purpose the printing device or apparatus may be situated in an enclosed space within which the temperature is selectively regulatable.

Figure 3:
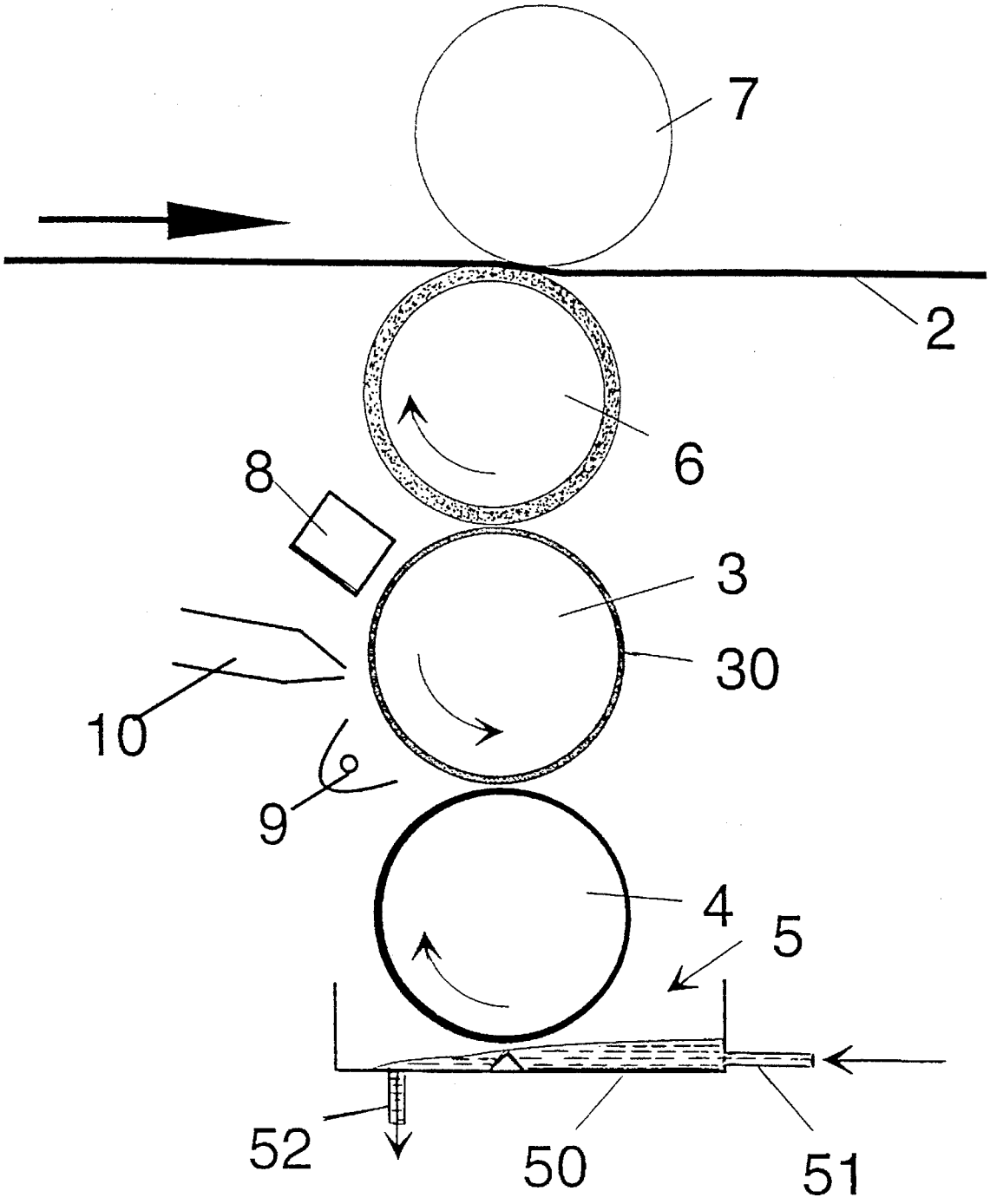
FIG. 3 diagrammatically depicts a printing apparatus similar to that of FIG. 2, wherein the outer surface or layer of the form cylinder is heated by a heating device.

With particular reference now to FIG. 3, after polarization has been accomplished and before the printing process begins, the temperature of the printing form 30 is again elevated—to a higher temperature $T_2$, as for example 25° C.—proceeding from its outer surface, by a heating device 9 and is maintained at this elevated temperature. In so doing, it must be ensured that the temperature $T_2$ lies below the Curie temperature of the ferroelectric material forming the imaging surface of the form 30. This elevated temperature causes an increase in the number of surface charges present on the surface of the printing form 30. The charge required to compensate for the internal electric field (in accordance with FIG. 1) is dependent on temperature—the higher the temperature, the less compensating charge is required. If polarization is effected at a low temperature, the excess compensating charge is released when the temperature is increased. Thus, the positively-polarized region has free positive charges and the negatively polarized region has free negative charges. Since the number of free surface charges on the surface of the printing form increases with higher temperature, there is a corresponding increase in contrast—i.e. in the potential difference between the positively and negatively poled regions. Accordingly, when the particles are for example positively charged, more toner particles are deposited on negatively charged image areas and background tones are prevented or suppressed. The increased : contrast tension between the image regions and the background regions thus improves the optical contrast between the image and background regions or, put another way, produces a denser layer of toner in the printing regions with a background that is substantially free of toner. This effect may be achieved and utilized for a large number of successive printing processes, such as, for example, on the order of 1000 passes or imaging operations. Unavoidably, however, some of the surface charge on the printing form 30 will be carried away by toner particles onto the transfer cylinder 6 and, from the cylinder 6, to the printing stock web 2. A cooling device 10 is preferably arranged adjacent to the form cylinder to cool the printing form 30 either before or after the toner is transferred to the transfer cylinder 6. When such cooling is effected before the toner is transferred from the form 30, the free surface charge is again bound as a compensation charge due to the reversible pyroelectric effect. When cooling is, on the other hand, effected after the delivery of the toner, the required compensation charge is transmitted by the surrounding medium to the surface and fixed.

The compensation charge required for this pyroelectric effect is transmitted by the surrounding medium, e.g. air, to the surface and bound thereon. As a result of the presence and operation of the cooling device 10, the printing form 30 takes on a temperature $T_3$ which lies below temperature $T_2$. The printing form 30 is then reheated to temperature $T_2$ by means of the heating device 9 and an excess charge once more develops on the surface, providing the increased contrast effect described hereinabove. The cooling process may be implemented continuously or, in the alternative, periodically after a predetermined number of printing passes or operations when the number of free surface charges has correspondingly decreased. The amount of heat supplied by the heating device 9 may also be dissipated or decreased by continuous cooling.

As should be apparent to those skilled in the pertinent arts, other devices—as for example a belt—may instead be used in lieu of the printing roller 4 for applying toner 50 to the printing form 30.

When a liquid toner is used in place of the dry toner 50, the cooling of the printing form 30 brought about by removal of the evaporation heat as the toner liquid evaporates may itself, in certain cases, be sufficient for decreasing the temperature of the form 30 suitably below the temperature $T_2$.

It is also contemplated that the heating device 9 be replaced by an arrangement for heating the surface of the printing form 30 by immersion of the form 30 in a bath of liquid toner that has been heated to the desired temperature $T_2$.

Figure 4:
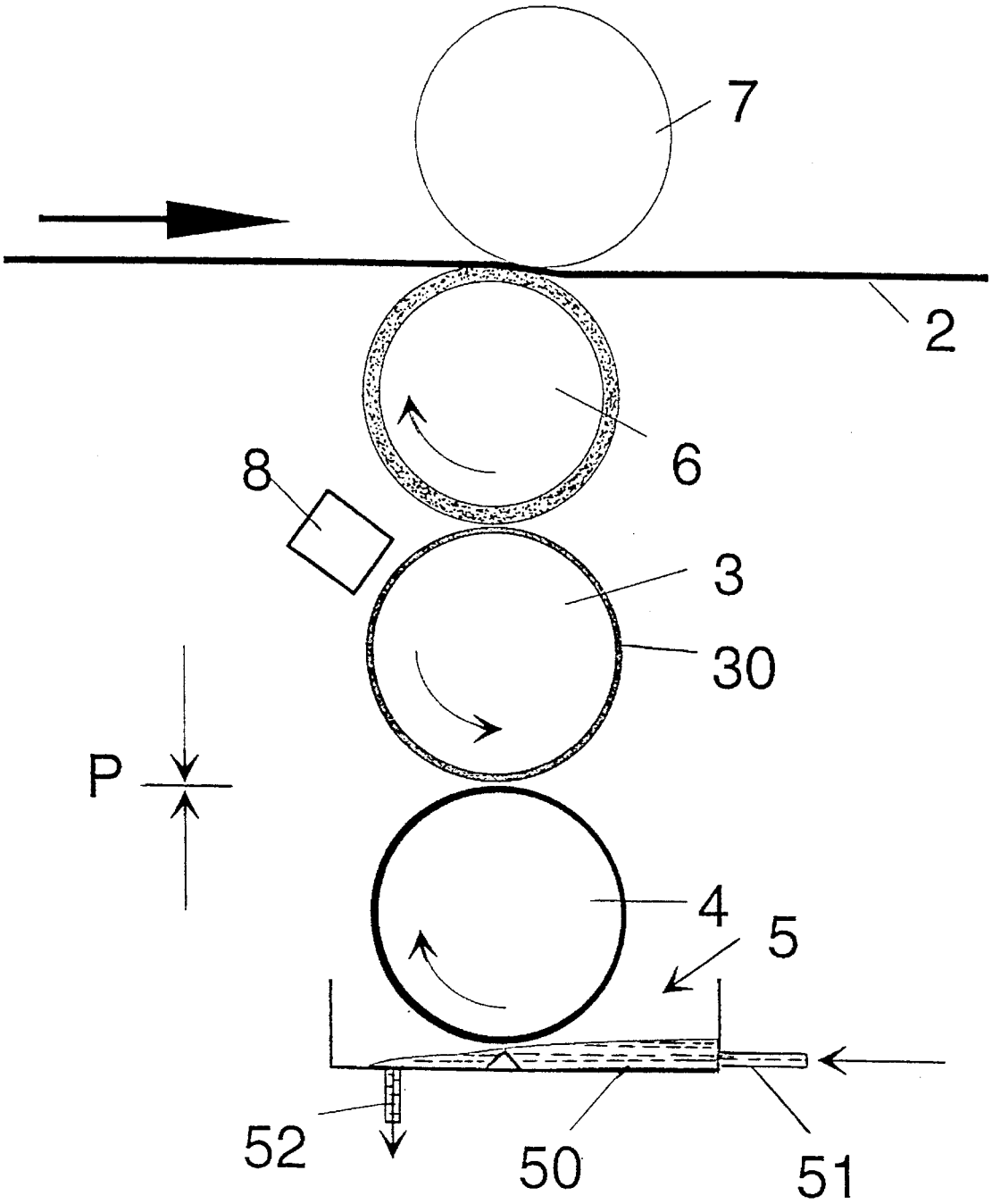
FIG. 4 diagrammatically depicts yet another printing device similar to that of FIG. 2, in which the toner applicator roller for applying toner to the form cylinder operatively presses against the form cylinder for effecting the transfer of toner therebetween.

Furthermore, in each of the inventive processes for increasing contrast by providing an additional charge carrier source or selectively increasing (and decreasing) the printing form temperature, the number of available charges on the surface of the printing form 30 may also be increased by applying a mechanical force to the surface. This may for example be accomplished by pressing the toner applicator roller 4 against the form cylinder 3 with a given predetermined pressure p, as depicted in FIG. 4. The free surface charge is thus formed by the piezoelectric effect occurring in the ferroelectric material.

The apparatus or devices depicted in FIGS. 2 to 4 and described hereinabove may be used in a particularly advantageous manner when toner application electrodes and toner removal electrodes 13, 14 are additionally provided as shown in FIG. 2. These electrodes 13, 14 are located at a predetermined spacing or distance relatively closely proximate the surface of the printing form 30 and influence the extent to which the toner is accepted by the surface of the printing form 30. For example, negatively-charged toner particles are repelled by a negatively-charged electrode 13 and are accepted with much more intensity and rapidity by positively-charged image regions on the printing form 30. Conversely, when the electrode 14 is positively charged, the attachment of negatively-charged toner particles to non-image regions that are likewise negatively charged is that much more readily prevented. The contrast between image regions and non-image regions is thereby correspondingly increased and the accumulation of toner in background or non-image regions is effectively avoided.

The present invention accordingly provides various processes by which the amount of available charge on the surface of a printing form 30 having a ferroelectric surface layer may be increased, thus likewise increasing the potential difference between the image and non-image regions on the printing form. In various aspects or alternative embodiments of the invention, either the temperature at the surface of the printing form 30 is increased relative to the temperature at which polarization was effected, or the printing form cylinder 3 is mechanically loaded for transferring the toner under pressure, or excess or additional charge carriers are uniformly applied to the entire surface of the printing form 30, so as to create an enhanced potential difference between positively-polarized regions and negatively-polarized regions and thereby increase the image contrast between image and non-image regions.

Thus, while there have shown and described and pointed out fundamental novel features of the invention as applied to preferred embodiments thereof, it will be understood that various omissions and substitutions and changes in the form and details of the described apparatus and processes may be made by those skilled in the art without departing from the spirit of the invention. It is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. A method of producing a master image on a printing form comprising a layer of ferroelectric material for subsequent toner-based transfer of the master image from the printing form onto a printing substrate, comprising the steps of:

(A) polarizing the ferroelectric material layer at a first temperature $T_1$ in accordance with an image to be transferred to the printing substrate so as to form on the layer a pattern of electrical surface charges representing the image to be transferred and defining the master image on the layer; and (B) after said polarizing of the layer, applying an additional electrical charge to and substantially uniformly over the layer from a charge carrier source so as to increase the surface charges on the layer and provide increased contrast of the master image defined on the layer.

2. A method in accordance with claim 1, wherein said step (B) comprises applying an additional electrical charge to and substantially uniformly over the layer from one of a positive electrode and a negative electrode disposed proximate the ferroelectric material layer for transmitting charges from the electrode to the layer.

3. A method in accordance with claim 1, wherein said step (B) comprises applying an additional electrical charge to and substantially uniformly over the layer by transmitting the additional electrical charge to the ferroelectric material layer using a nonconducting dielectric layer.

4. A method in accordance with claim 1, wherein said step (B) comprises applying an additional electrical charge to and substantially uniformly over the layer by corona discharge from an electrode disposed in contact relation with the ferroelectric material layer.

5. A method in accordance with claim 1 wherein the master image is defined on the ferroelectric layer by oppositely-polarized image regions and non-image regions on the layer, and wherein said step (B) comprises applying to and substantially uniformly over the layer an additional electrical charge of each of a first polarity and of a second polarity opposite the first polarity so as to compensate for different charge carrier densities of the free surface charges in the image regions and non-image regions.

6. A method in accordance with claim 1 wherein the master image is defined on the ferroelectric layer by oppositely-charged image regions and non-image regions on the layer, and wherein said step (B) comprises applying to and substantially uniformly over the layer an additional electrical charge of each of a first charge type and of a second charge type opposite the first charge type so as to compensate for different charge carrier densities of the free surface charges in the image regions and non-image regions.

7. A method in accordance with claim 1, wherein said step (B) further comprises generating the additional electrical charge by one of friction, contact of the ferroelectric material layer with an electrode, and corona discharge.

8. A method in accordance with claim 1 wherein the ferroelectric material layer has a Curie temperature, and wherein said step (B) comprises:

(i) heating the ferroelectric material layer to a second temperature $T_2$ greater than said first temperature $T_1$ and less than the Curie temperature; and (ii) applying charged toner particles to the layer, while the ferroelectric material layer is at said second temperature $T_2$, for subsequent transfer of the charged toner particles from the layer to a printing substrate.

9. A method in accordance with claim 8, wherein said step (B)(i) comprises heating the printing form to the temperature $T_2$.

10. A method in accordance with claim 8, further comprising the steps of:

(C) after said step (B), cooling the ferroelectric material layer to a third temperature $T_3$ less than said second temperature $T_2$; and (D) after said step (C), heating the ferroelectric material layer to said second temperature $T_2$.

11. A method in accordance with claim 10, further comprising the step of:

(E) after said step (D), applying additional charged toner particles to the layer, while the ferroelectric material layer is at said second temperature $T_2$, for subsequent transfer from the layer to a printing substrate.

12. A method in accordance with claim 10 wherein the charged toner particles are carried in a liquid for application to the layer, and wherein said step (C) comprises cooling the ferroelectric material layer to the third temperature $T_3$ by evaporating the liquid in which the charged toner particles are carried.

13. A method in accordance with claim 12, further comprising the step of:

(E) after said step (D), applying additional charged toner particles to the layer, while the ferroelectric material layer is at said second temperature $T_2$, for subsequent transfer from the layer to a printing substrate.

14. A method in accordance with claim 10, wherein said step (D) comprises heating the ferroelectric material layer to said second temperature $T_2$ by immersing the layer in a toner bath of temperature $T_2$.

15. A method in accordance with claim 13, wherein said step (D) comprises heating the ferroelectric material layer to said second temperature $T_2$ by immersing the layer in a toner bath of temperature $T_2$.

16. A method in accordance with claim 1, further comprising the steps of:

(C) applying charged toner particles to the ferroelectric material layer on which the master image is defined; and (D) applying a mechanical force to the ferroelectric material layer so as to increase the surface charges on the layer.

17. A method in accordance with claim 16, wherein the printing form is carried on a peripheral surface of a form cylinder and said step (C) comprises applying charged toner particles to the ferroelectric material layer from a toner applicator roller disposed closely proximate the form cylinder, said step (D) comprising pressing the toner applicator roller against the printing form on the form cylinder.

18. A method of producing a master image on a printing form comprising a layer of ferroelectric material for subsequent toner-based transfer of the master image from the printing form onto a printing substrate, comprising the steps of:

(A) polarizing an entire surface of the ferroelectric material layer in a first polarization direction;

(B) after said step (A), applying an additional electrical charge to the entire surface of the layer from a first electrode;

(C) after said step (B), polarizing the ferroelectric material layer in a second polarization direction opposite said first polarization direction in accordance with an image to be transferred to the printing substrate so as to form on the layer a pattern of second polarization direction electrical surface charges in image regions of the layer representing the image to be transferred and defining the master image on the layer; and (D) after said step (C), applying an additional electrical charge of said second polarization direction to and substantially uniformly over the entire surface of the layer from a second electrode so as to increase the image-defining surface charges on the layer and provide increased contrast of the master image defined on the layer.

19. A method in accordance with claim 18, wherein said step (B) comprises applying an additional electrical charge of said first polarization direction to the entire surface of the layer from a first electrode.

20. A method in accordance with claim 18, wherein said step (B) comprises applying an additional electrical charge of said first polarization direction to and substantially uniformly over the entire surface of the layer from a first electrode.

* * * * *